US005474285A

United States Patent [19]

Stauber

[11] Patent Number: 5,474,285

[45] Date of Patent: Dec. 12, 1995

[54] APPARATUS FOR OPENING AND FURTHER TRANSPORTING PRINTED PRODUCTS

[75] Inventor: Hans-Ulrich Stauber, Grüt, Switzerland

[73] Assignee: Ferag AG, Switzerland

[21] Appl. No.: 312,222

[22] Filed: Sep. 26, 1994

[30] Foreign Application Priority Data

Oct. 8, 1993 [CH] Switzerland ..... 0303493

[51] Int. Cl.[6] ..... B65H 5/30

[52] U.S. Cl. ..... 270/54

[58] Field of Search ..... 270/54, 55, 57; 271/246, 247, 277, 204, 206

[56] References Cited

U.S. PATENT DOCUMENTS

| | | | |
|---|---|---|---|
| 2,817,513 | 12/1957 | Bell et al. . | |
| 2,969,981 | 1/1961 | Faeber . | |
| 3,481,594 | 12/1969 | McCain et al. . | |
| 3,527,455 | 9/1970 | Reist | 270/55 |
| 3,580,562 | 5/1971 | Reist . | |
| 3,601,388 | 8/1971 | Hilliard . | |
| 3,623,386 | 3/1970 | Bach et al. . | |
| 3,650,524 | 3/1972 | Hepp . | |
| 3,722,877 | 3/1973 | Wetter . | |
| 4,007,824 | 2/1977 | Reist . | |
| 4,126,390 | 11/1978 | Connin . | |
| 4,201,286 | 5/1980 | Meier . | |
| 4,205,837 | 6/1980 | von Hein et al. . | |
| 4,320,894 | 3/1982 | Reist et al. . | |
| 4,333,559 | 6/1982 | Reist . | |
| 4,381,056 | 4/1983 | Eberle . | |
| 4,398,710 | 8/1983 | Hansch . | |
| 4,489,930 | 12/1984 | Meier | 270/55 |
| 4,555,101 | 11/1985 | Stobb | 270/58 |
| 4,605,213 | 8/1986 | Hechler . | |
| 4,641,825 | 2/1987 | Mowry . | |
| 4,678,174 | 7/1987 | Reist | 270/54 |
| 4,684,116 | 8/1987 | Hansch | 270/54 |
| 4,684,117 | 8/1987 | Honegger et al. | 270/54 |
| 4,709,910 | 12/1987 | Honegger | 270/55 |
| 4,729,554 | 3/1988 | Honegger | 270/55 |
| 4,775,137 | 10/1988 | Glanzmann . | |
| 4,893,805 | 1/1990 | Eberle . | |
| 5,052,667 | 10/1991 | Hansch | 270/55 |
| 5,104,108 | 4/1992 | Honegger | 270/54 X |
| 5,137,409 | 8/1992 | Honegger | 270/55 X |

(List continued on next page.)

FOREIGN PATENT DOCUMENTS

| | | |
|---|---|---|
| 0095603 | 5/1983 | European Pat. Off. . |
| 0169490 | 7/1985 | European Pat. Off. . |
| 0208081 | 5/1986 | European Pat. Off. . |
| 0379879 | 8/1990 | European Pat. Off. . |
| 1945501 | 3/1970 | Germany . |
| 2508194 | 9/1976 | Germany . |
| 3224138 | 6/1982 | Germany . |
| 618398 | 6/1977 | Switzerland . |
| 667859 | 7/1985 | Switzerland . |
| 512870 | 9/1939 | United Kingdom . |
| 1234720 | 6/1971 | United Kingdom . |

*Primary Examiner*—John E. Ryznic

*Attorney, Agent, or Firm*—Willian Brinks Hofer Gilson & Lione

[57] ABSTRACT

An apparatus for opening and transporting printed products having transporting clips, driven in conveying direction to hold the printed products at their fold. Below a conveying device there is a supporting element, which supports the printed products in their border region and with leading edge. Arranged on circulating carrying arms are suction-head-like opening elements which, by swivelling in of the carrying arms, engage between in each case two printed products and come to bear from above onto the border region of the printed product to be opened. Mounted on a hollow shaft is a suction roller, of which in each case a suction head comes to bear from below against the border region. For opening the printed product the opening element and the suction roller firmly hold the first and second product parts thereof respectively and lift the latter off from each other. Then a holding-open element enters from below between the product parts in order to hold open the printed product during further transport.

14 Claims, 6 Drawing Sheets

U.S. PATENT DOCUMENTS 5,169,139 12/1992 Stauber et al. .
5,188,349 2/1993 Honegger .
5,248,135 9/1993 Leu ..... 270/55
5,292,111 3/1994 Hansch ..... 270/54
5,301,937 4/1994 Hansch .
5,324,014 6/1994 Honegger et al. ..... 270/55
5,354,043 10/1994 Reist ..... 270/54

APPARATUS FOR OPENING AND FURTHER TRANSPORTING PRINTED PRODUCTS

BACKGROUND OF THE INVENTION

The present invention relates to an apparatus for opening and further transporting folded printed products.

An apparatus of this type is disclosed in the older, later-published Swiss Patent Application No. 03 724/92-1. By means of transporting clips of a conveying device, folded printed products are held at the fold and transported while suspended. With their end region opposite the fold, they come into bearing contact with a supporting element, whereby the end region, seen in the conveying direction, is bent backward. An opening unit has a carrying element, which is designed in the manner of a star wheel. On the radial carrying arms of the star wheel grippers are arranged. The grippers have a gripper jaw, fastened on the carrying arm, and a gripper tongue interacting with the jaw and mounted on the carrying element. Openings in the gripper jaw and the gripper tongue on the active clamping side can be connected to a vacuum source. A gripper picks the printed product up from the rear supported in the border region. The product is then seized and held by closing of the gripper at the edge opposite the fold. Once the gripper moved along with the printed product has moved away out of the region of the supporting element, the gripper tongue is transferred into the open position. The two product parts are firmly held at the gripper tongue and gripper jaw, respectively, and lifted off from each other on account of the openings connected to the vacuum source. By disconnecting the opening of the gripper jaw from the vacuum source, the corresponding, lower product part is released. This product part is pushed-off from the gripper jaw by means of an angle lever which is mounted on the carrying element and carries at its end a stabbing element, stabbing between the printed products lifted off from each other. As a result, the printed product is further opened. A holding-open element engages between the two product parts, lifted off from each other, after which the opening of the gripper tongue is also disconnected from the vacuum source. In this document it is also mentioned that it is conceivable to open printed products with a leading end region by means of such an opening unit.

With this known device, the printed products are only slightly lifted off from each other, preopened, by the gripper jaws and gripper tongues acting like suction heads. The actual opening is performed by pushing the one product part off the gripper jaw by means of the stabbing element and angle lever. After the pushing off, consequently the pushed-off product part is no longer held, which may limit the permissible processing speed. Furthermore, during pushing off, the edge opposite the fold is acted upon, which could result in damage to the printed product. Moreover, the attainable opening of the printed product is restricted and the opening is not accessible along the entire edge.

Therefore, in view of the above, it is an object of the present invention to provide an apparatus for opening and further transporting folded printed products which, at great processing speed, allows opening which is reliable and gentle on the printed products and which permits at any desired location the inserting of a holding-open element between the product parts lifted off from each other.

SUMMARY OF THE INVENTION

According to the invention, the printed products are held at their fold by means of transporting clips, are transported substantially in a vertical suspended position and are pushed approximately in the conveying direction while supported by their end region which is opposite the fold and is bent forward in the conveying direction. This arrangement provides the open edge of the printed products, opposite the fold, with a defined position, stabilizes the printed products by the bending, and keeps the printed products at a certain distance from one another, so that an opening element can be entered between printed products from above the supporting element supporting the printed products.

As a result, the accessibility to the supported border region from above is also ensured, so that the opening element can come to bear in the border region flat against the top product part, in order to hold the latter firmly. Since the opening element engages between the printed products and comes to bear against the latter from above the supporting element and a holding element comes to bear against the printed product from below, the product parts can be held firmly during the entire opening operation, which ensures reliable opening at high processing speed. Moreover, no parts of the opening unit are in the region of the open edge opposite the fold. Thus, a holding-open element can engage at any desired location between the product parts lifted off from each other. Moreover, a large opening stroke is attainable, since the circulating path of the holding element and path of movement of the opening element can have a form independent of each other.

In a preferred embodiment of the apparatus according to the invention, the opening element engages from the side between the printed products. Accordingly, the apparatus can be of a simple and space-saving design. In another preferred embodiment, the corresponding product part is bent around a roller in the downward direction and, if appropriate, toward the rear. As a result, the end opposite the fold of the corresponding product part is conveyed downward toward the holding-open element. As a result, the printed product is stretched at the same time, reducing the bending induced by the supporting element. This results in increased stability in the printed product and a rapid reliable meshing of the holding-open element and the product part.

The apparatus of the invention allows a high processing capacity with smooth running of the apparatus.

In another preferred embodiment, the product part held by the opening element is drawn along a curved path in conveying direction, and also in the downward direction. As a result, the bending in the product part is reduced and a quick meshing of the holding-open element with the product part is achieved.

BRIEF DESCRIPTION OF THE DRAWINGS

The present invention is now explained in more detail with reference to the drawings, in which purely diagrammatically.

DETAILED DESCRIPTIONS OF THE PRESENTLY PREFERRED EMBODIMENTS

Figure 1:
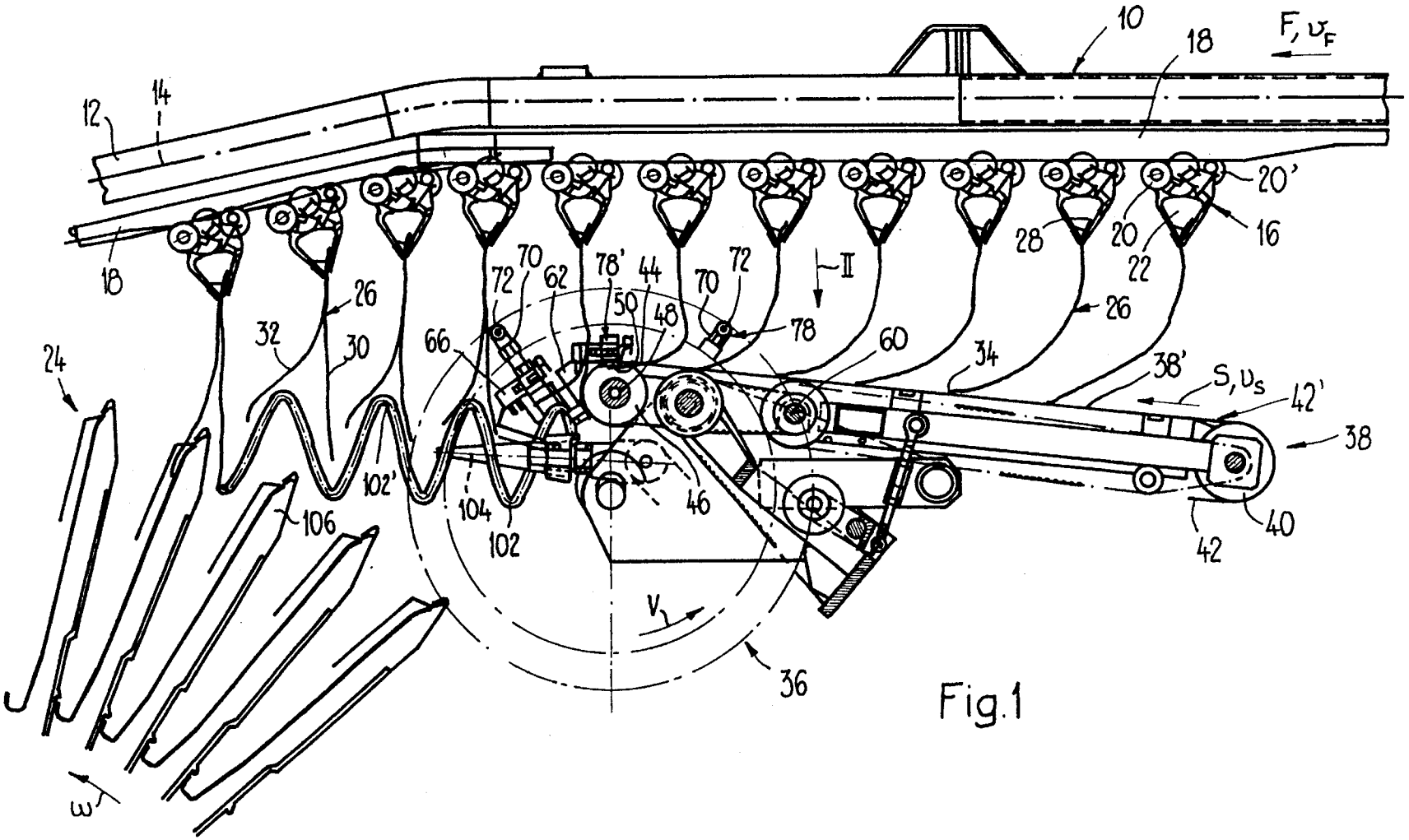
FIG. 1 shows in elevation an embodiment of the apparatus according to the invention, with a conveying device for the suspended transporting of printed products, an opening unit arranged below the latter for opening the printed products, and also an indicated processing drum, on the rests of which the opened printed products are deposited for further processing.

FIG. 1 shows a conveying device 10 of a known type, which has individually controllable transporting clips 16 which are arranged at intervals on a conveying chain 14. The conveying chain 14 is driven in circulation in a conveying direction F and at a conveying speed $v_f$ and is guided in a channel 12. The swivelling position of the transporting clips 16 about an axis running respectively at right angles to the conveying direction F is controlled by means of fixed-in-place swivelling links or cams 18. The links or cams 18 interact with the follow-up rollers 20, 20' of the transporting clips 16 in such a way that the clip mouth 22 in the section shown of the conveying device 10 is directed substantially downward in the vertical direction. It should also be mentioned that a triggering member is arranged above approximately the center of an indicated processing drum 24, in order to control the opening of the gripping mouth 22. Transporting clips 16 of this type are known, for example, from EP-A-O 557 680 and the corresponding U.S. patent application Ser. No. 08/018,749.

Furthermore, the clip mouth 22 of the transporting clips 16 is aligned at right angles to the conveying direction F. The clip mouth 22 is intended for holding in each case in a suspended manner a folded printed product 26 in a region adjacent to the fold 28 running approximately in the horizontal direction and approximately at right angles to the conveying direction F. The fold joins two product parts 30, 32. The first product part 30 (seen in conveying direction F) trails with respect to the second product part 32. The open edge, referred to as the cut edge, opposite the fold 28 of the printed products 26 is denoted by 34.

Arranged below the section of the conveying device 10 (running approximately in the horizontal direction) is an opening unit 36, which is described in more detail below. The opening unit 36 is directly preceded by a supporting element 38, which is likewise arranged below the conveying device 10 and has endless supporting element 38. The printed products 26 come into bearing contact with their edge 34 onto the supporting bands 42, which are led around deflecting rollers 40. The upper effectively supporting strand 42' is arranged rising slightly (seen in conveying direction F) and is driven in a circulating direction S at a speed $v_s$. The speed $v_1$ is greater, preferably twice as great, as the conveying speed $v_f$. In the initial region of the supporting element 38, the printed products 26 come into bearing contact with their edge 34 onto the supporting bands 42 and are bent forward during the course of further transport in the conveying direction F, so that they lie flat with their end region 44, adjoining the edge 34, on the supporting band 42. The supporting bands 42 consequently form a conveying plane 38', which pushes the end region 44 of the printed products 26 in the conveying direction F.

The opening unit 36 is now described in more detail with reference to FIG. 1, together with FIGS. 2 to 4. The opening unit 36 has a suction roller 46, which is mounted freely rotatably on the same hollow shaft 48, arranged horizontally and at right angles to the conveying direction F, as the deflecting rollers 40 for the supporting bands 42 at the end of the supporting element 38. The suction roller 46 has, distributed uniformly in the circumferential direction, three suction heads 50 for holding the printed products. The circulating path of the three suction heads 50 substantially forms a tangent with respect to the conveying plane 38' defined by the upper strand 42' of the supporting bands 42. The suction heads 50 are adjoined by radial passages 52 through the suction roller 46. These radial passages 52 interact with openings in the hollow shaft 48 in order to connect the suction heads 50 in dependence on the rotational position of the suction roller 46 temporarily to the interior of the hollow shaft 48, which is connected to a vacuum source (not shown). In the hollow shaft 38 there engages, from the end on the opening unit side, a tubular control pin 54. The rotational position of the control pin 54 with respect to the hollow shaft 48 is adjustable and has a venting channel 56, in order immediately after separating the connection of a radial passage 52 to the interior of the hollow shaft 48 to connect the radial passage 52 to the surroundings and supply air to the respective suction head 50. As revealed in particular by FIGS. 2 and 3, the suction roller 46 is connected via a toothed-belt drive 58 to a drive shaft 60, driven in time with the conveying device 10, in such a way that the suction heads 50 cover a path in the rotating direction U (compare FIG. 5) which corresponds approximately to 75% of the path which the transporting clips 16 cover in the same time.

Figure 2:
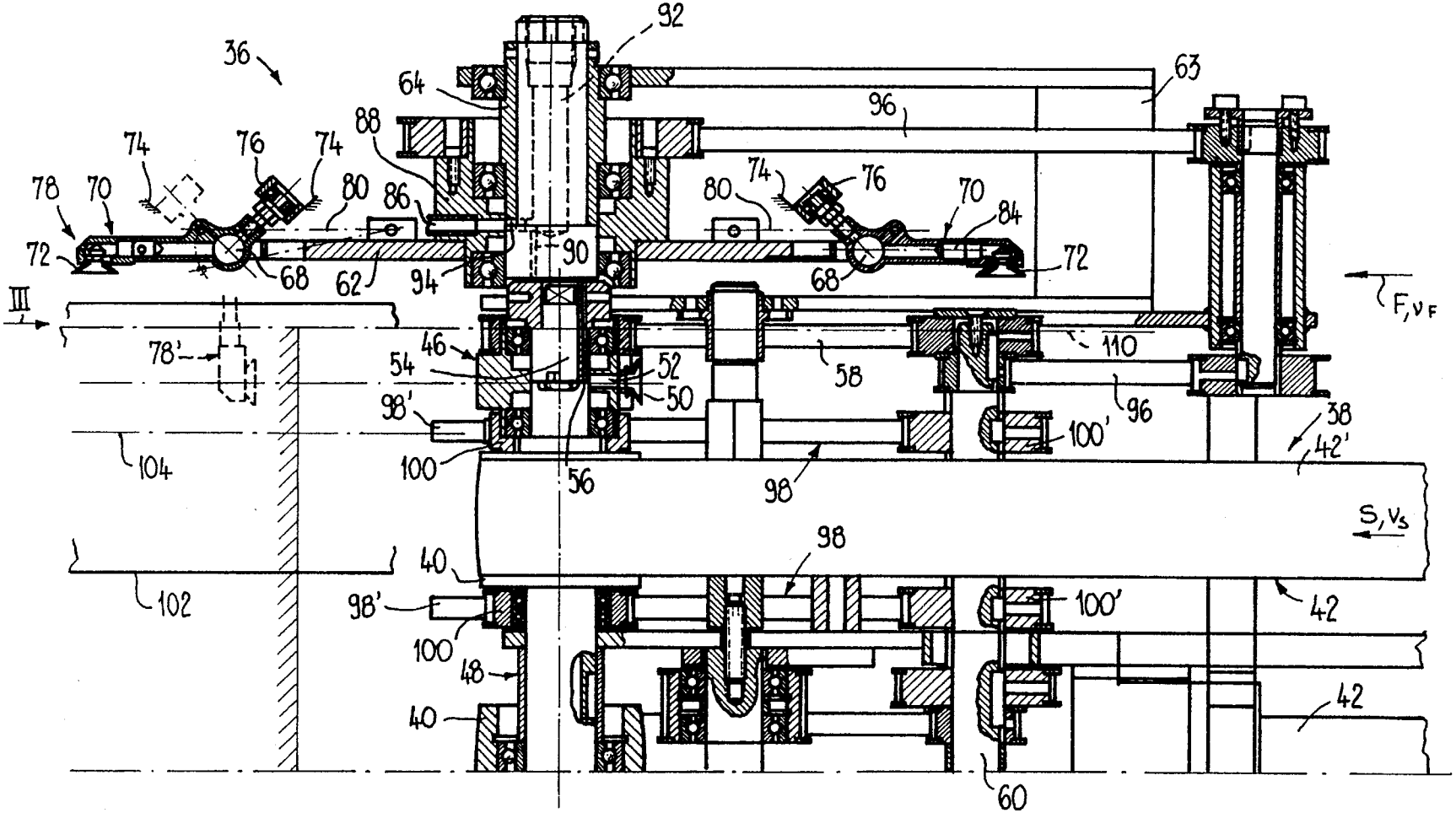
FIG. 2 shows in plan view according to the arrow II of FIG. 1 and partly in section a part of the opening unit and supporting element.
Figure 3:
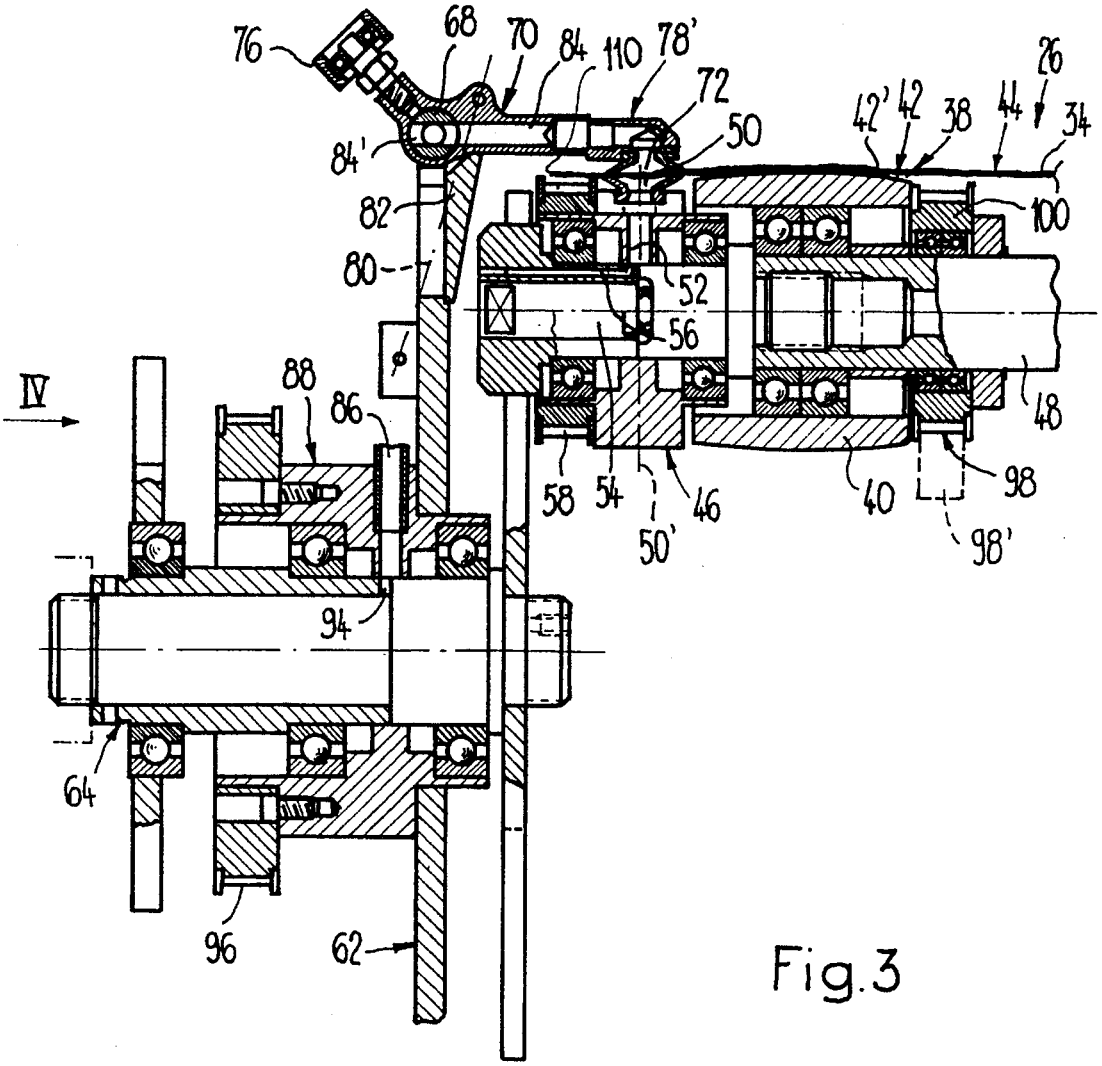
FIG. 3 shows in side view corresponding to the arrow III of FIG. 2 and partly in section the opening unit.
Figure 4:
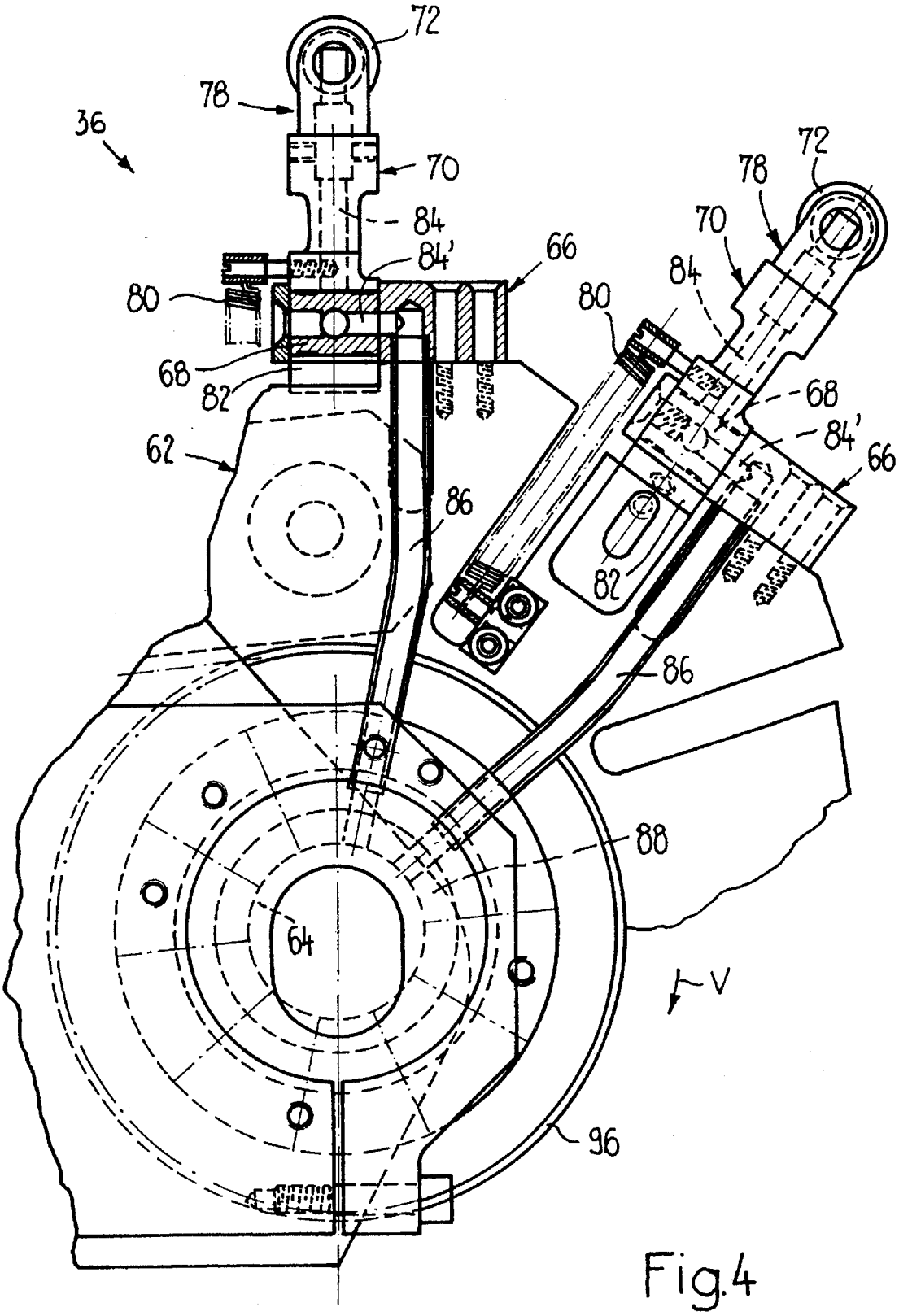
FIG. 4 shows in side view corresponding to the arrow IV of FIG. 3 and likewise partly in section a cut out from the opening unit.

As seen in particular from FIGS. 2 and 3, the opening unit 36 is arranged offset in the direction of the axis of the hollow shaft 48 outside the supporting element 38 formed by the supporting bands 42. In the embodiment shown, the opening unit 36 is to the right (seen in conveying direction F) with respect to the outermost supporting band 42 on this side.

Seen in the direction of the hollow shaft 48, the opening unit 36 has on the side of the suction roller facing away from the supporting bands 42 a disk-like designed carrying element 62, which is mounted freely rotatably on a spindle 64 fastened on the frame 63. The spindle 64 runs at right angles to the conveying direction F and in the horizontal direction and is arranged offset downward in approximately vertical direction with respect to the hollow shaft 48. Fastened radially on the outside on the carrying element 62 (distributed in the circumferential direction) are bearing blocks 66, on the bearing shanks 68 of which, running at right angles to the spindle 64 and in a tangential direction, there is in each case swivel-mounted a double-lever-like carrying arm 70. The latter bears at one end an opening element 72, designed as a suction head, and at the other end a control roller 76, interacting with controlling links or cams 74. The carrying arm 70 is able to swivel by means of the controlling links 74 out of a rest position 78, shown in FIGS. 2 and 4, into a working position 78', represented in FIG. 3, and back again. In the working position 78', the part of the carrying arm 70 carrying the opening element 72 runs approximately parallel to the spindle 64 and projects from the carrying element 62 in the direction toward the suction roller 46, so that in the working position 78' the opening element 72 moves in that plane in which the suction heads 50 of the suction roller 46 circulate. In the rest position 78, the part of the carrying arm 70 carrying the opening element 72 runs approximately in the radial direction with respect to the spindle 64 and hollow shaft 48, with opening element 72 lying on the outside with respect to the bearing shank 68. Between the carrying arm 70 and the carrying element 62 there acts a spring 80, in order to urge the carrying arm 70 into the rest position 78 and the working position 78', against stops 82 defining these position.

The suction-head-like opening element 72 communicates in the working position 78' via a channel 84 in the carrying arm 70 with a further channel 84' in the bearing block 66. The further channel 84' is connected via a pipeline 86 to a valve member 88, which is arranged on the spindle 64. The valve member 88 is intended for connecting the pipeline 86 in dependence on the rotational position of the carrying element 62 to a vacuum source (not shown) or to a venting passage 90 connected to the surroundings. For this purpose, the spindle 64 has a hollow space 92 which is connected to the vacuum source and into which there opens a radial opening 94. Upon turning the carrying element 62 in the direction of rotation V (which is in the same sense as the direction of rotation U of the suction roller 46) the opening 94 comes temporarily into connection with the pipeline 86, in order to generate reduced pressure in the opening element 72. Following in the direction of rotation V of the opening 94, upon further turning the pipeline 86 comes into connection with the venting passage 90, in order to vent the opening element 72.

The carrying element 62 is connected via a further toothed drive 96 to the drive shaft 60 in such a way that the opening elements 72 in the working position 78' of the carrying arms 70 cover in each cycle a path which corresponds approximately to 80% of the path of the transporting clips 16. Moreover, it should be mentioned that the radius of that section 97' of the path of movement 97 of the opening elements 72 with carrying arms 70 swivelled into the working position 78' is greater, preferably two to ten times greater, than the radius of the circulating path 50' of the suction heads 50 of the suction roller 46. The number of opening elements 72 on the carrying element 62 is fixed in such a way that in each working cycle there is in each case an opening element 72 at a particular location. It should also be mentioned that the section 97' of the path of movement 97 of the opening elements 72 in which the carrying elements 70 are swivelled into the working position 78' is approximately at a tangent with respect to the conveying plane 38'.

Furthermore (seen in the direction of the hollow shaft 48) between the supporting bands 42 and, if appropriate, between the outermost supporting band 42, facing the opening unit 36, and the suction roller 46 there are arranged endless cam belts 98. The cam belts are led around deflecting wheels 100, mounted freely rotatably on the hollow shaft 48, and around deflecting wheels 100', seated in a rotationally fixed manner on the drive shaft 60. The drive shaft 60 runs parallel to the hollow shaft 48, through between the strands of the supporting straps 42, so that the cams 98' of the cam belts 98 penetrate the conveying plane 38' from below, between the drive shaft 60 and hollow shaft 48, and project with their free end beyond said plane. The cam belts 98 are driven at a speed $v_n$ which is greater than or equal to the speed $v_u$ of the suction heads 50. It is preferably about 80% of the speed $V_f$ of the transporting clips 16. Correspondingly, the distance between the cams 98 is approximately 80% as great as the distance between the transporting clips 16.

Furthermore, the opening unit 36 has a helically shaped holding-open element 102. The holding-open element 102 is driven rotatingly about its helix axis 104, running approximately parallel to the conveying direction F, in such a way that the respective upper section 102' moves along with the transporting clips 16 in conveying direction F. These sections 102' in each case engage between the product parts 30, 32, lifted off from each other during opening, in order to hold the latter open during further transport. As FIG. 1 shows, the processing drum 24, driven rotatingly in the direction of rotation W, is synchronized with the opening unit 36. Consequently, it is also synchronized with the conveying device 10, in such a way that a saddle-shaped rest 106 in each case engages from below in a winding of the holding-open element 102, moves with the latter in the conveying direction F and consequently stabs from below into the product parts 30, 32 lifted off from each other and held open.

Figure 5:
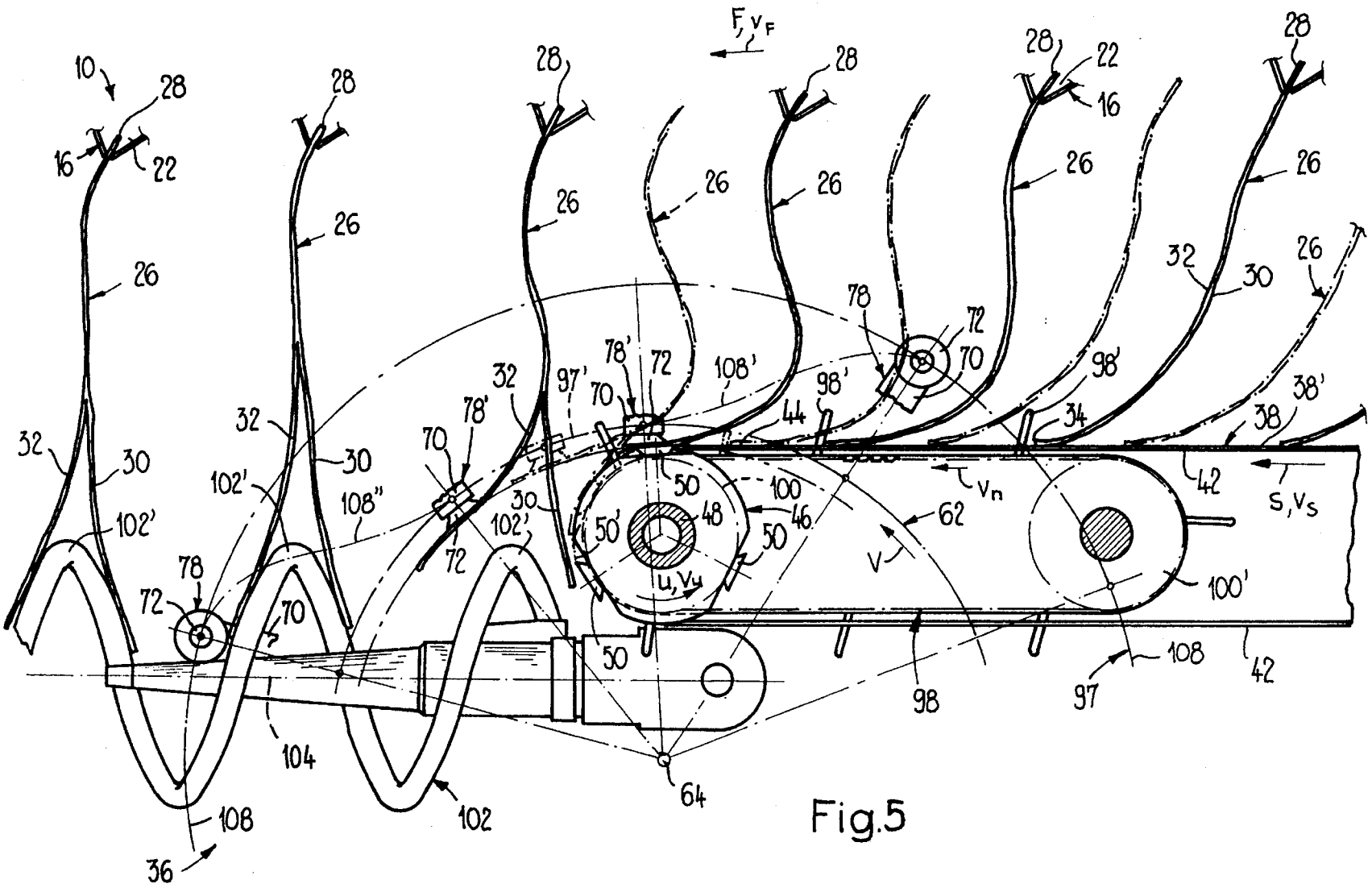
FIG. 5 shows in elevation and enlarged with respect to FIG. 1 a cutout of the apparatus shown there for illustration of the mode of operation.
Figure 6:
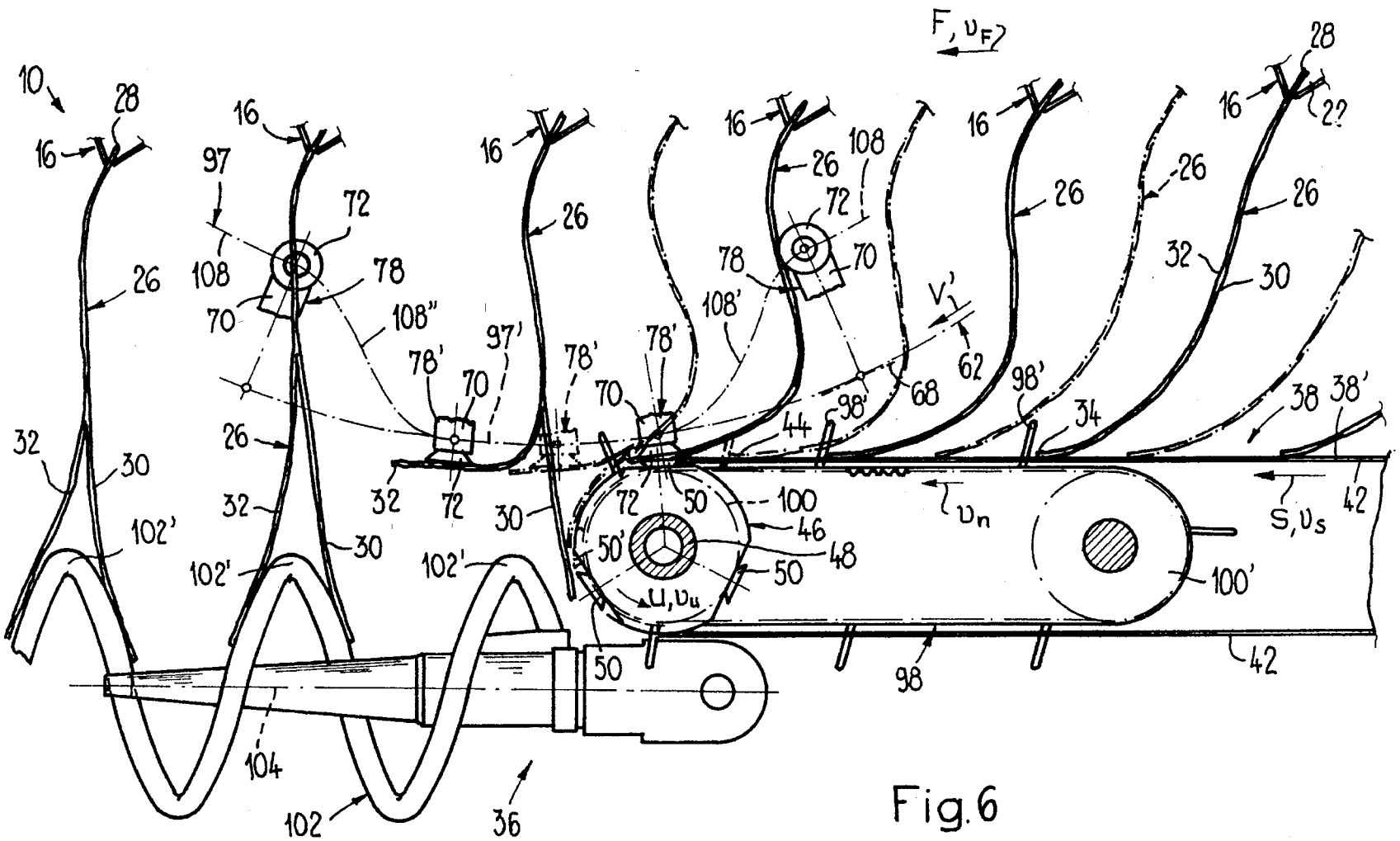
FIG. 6 shows in the same representation as in FIG. 5 a further embodiment of the apparatus according to the invention.

FIG. 6 shows in the same representation as FIG. 5 a further embodiment of the opening unit 36. The conveying device 10, the supporting element 38 with the supporting bands 42, the cam belts 98 and the holding-open element 102 are configured in precisely the same way as described further above. The difference is that the carrying element 62, now driven in the direction of rotation V', is mounted on a spindle corresponding to the spindle 64 which is arranged approximately in a vertical direction above the hollow shaft 48. The carrying arms 70 are likewise swivel-mounted by means of bearing blocks on the carrying element about bearing shanks 68 which run tangentially with respect to their path of rotation about the spindle. In working the position 78' of the carrying arms 70, the part of the latter carrying the opening element 72 protrudes approximately at right angles away from the carrying element 62. Upon swivelling back into the rest position 78, the opening elements 72 come to lie radially inward with respect to the bearing shanks 68.

In FIGS. 5 and 6, 108 denotes a return section of the path of movement 97, in which the opening elements 72 are in the rest position 78. The sections of the path of movement 72 in which the opening elements 72 are transferred from the rest position 78 into the working position 78' and back are denoted by 108' and 108", respectively.

The mode of operation of the apparatuses described is now described in more detail in particular with reference to FIGS. 5 and 6. In these, the clip mouths 22 of six transporting clips 16 are indicated in a way corresponding to six successive cycle intervals. Indicated in between, by dot-dashed lines, is the position of the printed products 26 which they assume midway between individual cycles. The printed products 26 rest with their border region 44 on the supporting bands 42 with their border region 44 bent forward. Due to frictional entrainment between the supporting bands 42, driven at greater speed $v_s$ with respect to the transporting clips 16, and the printed products 26, the latter are urged forward in the conveying direction F and come to bear with their open edge 34 for alignment against the cams 98'. Since the latter circulate at lower speed $v_n$ than the transporting clips 16, the printed products 26 are bent in the form of an S, which gives them stability. Then a carrying arm 70 is swivelled in from the side between two printed products 26 in each case. As a result, the respective opening element 72 is lowered along the helical path of movement section 108' onto the upper second product part 32 in the border region 44 of the printed product 26 trailing the carrying arm 70 (seen in conveying direction F). The synchronization between the carrying element 62 and the suction roller 46 is chosen in such a way that in each case a suction head 50 of the suction roller 46 and an opening element 72 take up between them the printed product 26 in the border region 44. The suction head 50 brought from below into bearing contact with the first product part 30 and the corresponding opening element 72 are connected to the vacuum source in order to hold firmly the first and second product parts 30, 32, respectively. By turning the suction roller 46, the first product part 30 is then bent around the latter and the upper second product part 32 is moved further, substantially in the conveying direction F, along the path of movement section 97' of the opening element 72. Due to the bending of the first product part 30 around the suction roller 46 and the movement of the respective opening element 72, the S-shaped bending in the printed product 26 is substantially discontinued. The holding-open element 102 stabs from below between the product parts 30, 32 lifted off from each other. Then, first the suction head 50 and second the opening element 72 are supplied with air, in order to release the corresponding product parts 30, 32. Upon further transport, the printed products 26 are held open by the section 102' of the holding-open element 102 respectively engaging between the product parts 30, 32. After supplying the opening element 72 with air, the respective carrying arm 70 is swivelled back into the rest position 78, the opening element 72 following along a helical path of movement section 108". As FIG. 1 shows, a saddle-like rest 106 of the processing drum 24 engaged in each case from below between the product parts 30, 32 lifted off from each other of a printed product 26, whereupon, by opening of the corresponding transporting clip 16, the printed product 26 falls astride onto the rest 106.

It should be mentioned that a carrying arm 70 is of course always swivelled in between two successive printed products 26, but in FIGS. 5 and 6 for the sake of better overall clarity in each case only one carrying arm 70 is shown in solid lines in four successive working cycles and in dot-dashed lines during opening midway between two working cycles. Since the cams 98' circulate with greater speed $v_n$ than the suction heads 50 ($v_u$), the cams move away from the edge 34 of the printed products 26 as soon as the product is seized by a suction head 50 and an opening element 72. This ensures that the opening of the printed products is not hindered by the cams 98'. This is true even if the latter are arranged rearwardly inclined (seen in conveying direction F) in the region of the upper actively straightening strand, in order to give the edges 34 a secured hold.

It goes without saying that since drive shaft 60 is synchronized with the conveying device 10, their mutual phase position can be set. Furthermore, the supporting element 38 and the opening unit 36 can be adjusted in height in the vertical direction in order to ensure adaptation to printed products 26 of different formats.

As best illustrated in FIGS. 2 and 3 (seen in the direction of the hollow shaft 48) the side border 110, facing the opening unit 36, of the printed products 26 is arranged between the suction roller 46 and the carrying element 62. In this manner the carrying element and the carrying arm 70, located in the rest position 78, can move with the opening elements 72 literally past the printed products 26. It also follows from this that, by means of the present opening unit 36, the printed products 26 are opened from corner regions formed by the side border 110 and the edge 34.

It is of course also conceivable to open printed products 26 for instance from the middle of the open edge 34. In this case, the suction roller 46 would have to be arranged in a corresponding position, and the part of the carrying arm 70 holding the opening element 72 would have to be lengthened correspondingly. It is also conceivable to arrange both the suction heads 50 and the carrying arms 70 on an endless circulating drawing member. Similarly, it is possible to arrange the opening elements 72 on carrying arms which are mounted displaceably in a translatory manner on a corresponding carrying element.

The apparatus according to the invention is suitable in particular for the opening of folded individual sheets, which for example form the title and back page of a periodical, and of 2-fold products, which have been folded a first time and folded a second time at right angles thereto, these products being transported during the last-formed fold 28 while held by the transporting clips and the first-formed fold forming the side border 110 facing the opening unit 36.

The foregoing description of the preferred embodiments of the present invention has been presented for purposes of illustration and description. The described embodiments are not intended to be exhaustive or to limit the invention to the precise forms disclosed. Obviously many modifications and variations are possible in light of the above teachings. The embodiments which were described were chosen in order to best explain the principles of the invention and its practical applications. It is intended that the scope of the invention be defined by the following claims, including all equivalents.

I claim:

1. An apparatus for opening and further transporting folded printed products wherein the products include first and second product parts joined at a fold and having free edges opposite the fold, comprising:

a conveying device including a plurality of transporting clips arranged at intervals, one behind the other, and adapted to hold individual printed products suspended by their folds and convey them in a conveying direction, with the folds arranged transversely of the conveying direction;

a supporting element arranged below the conveying device and forming a conveying plane moving substantially in the conveying direction and supporting the printed products in a border region along their free edges, with their border region bent forward relative to the rest of the suspended products as the printed products are conveyed;

an opening unit arranged below the conveying device, the opening unit including an opening element which engages and holds the uppermost product part in the forwardly bent border portion thereof and a holding element which engages and holds the lowermost product part in the forwardly bent border portion thereof;

the opening element and the holding element moving away from each other after engaging and holding respective product parts so as to move the product parts away from each other; and a holding open element which enters between the product parts after they are pulled away from each other to keep them separated as they are conveyed further.

2. An apparatus for opening and further transporting folded printed products wherein the printed products include first and second product parts joined at a fold and having free edges opposite the fold, comprising:

a conveying device including a plurality of transporting clips which are driven in a conveying direction, arranged at intervals one behind the other and adapted to hold individual printed products suspended at their fold and convey them with the folds transverse to the conveying direction;

a supporting element arranged below the conveying device, the supporting element forming a conveying plane moving substantially in the conveying direction and supporting the printed products in a border region, along their free edges with their border region bent forward in the conveying direction;

an opening unit arranged below the conveying device, and driven in time with the conveying device, the opening unit having an opening element and a holding element, the opening element circulating along a closed path of movement and engaging above the supporting element between successive printed products to come to bear from above against the upper product part of the printed product in the border region and to hold the upper product part firmly, the holding element moving along a closed circulating path and running along with the respective printed product to come to bear from below against the lower product part, bearing against the supporting element in the border region and holding the lower product part firmly, the circulating opening element and holding element moving away from each other for lifting the product parts off each other in an opening section downstream of the supporting element; and a holding-open element, running approximately in the conveying direction, the opening element and the holding element releasing the product parts when the holding-open element has entered between the product parts to hold open the opened printed product during further transport.

3. The apparatus as claimed in claim 2, wherein the path of movement of the opening element has a return section which is offset laterally, seen in conveying direction, with respect to the opening section and is followed by an entry section in which the opening element engages, seen in conveying direction, from the side between two successive printed products, and the transporting clips hold the printed products such that their side border, facing the opening unit, runs through, in a direction at right angles to the conveying direction, between the opening section and the return section.

4. The apparatus as claimed in claim 2, wherein the holding element and the opening element each comprise suction heads connected to a vacuum source, the suction heads holding the product parts.

5. The apparatus as claimed in claim 2, further comprising a roller rotating about a spindle running approximately at right angles to the conveying direction and parallel to the conveying plane, the holding element being disposed on the roller.

6. The apparatus claimed in claim 5, wherein a plurality of holding elements are disposed on the roller one after the other in the circumferential direction, and the roller is driven such that in the cycle a holding element in each case comes to bear against a printed product.

7. The apparatus as claimed in claim 2, comprising:

a carrying element which is rotatingly driven about an axis of rotation running approximately at right angles to the conveying direction and parallel to the conveying plane;

an arm, disposed on the carrying element, which bears the opening element and, in dependence on the rotational position of the carrying element, is brought out of a rest position into a working position and back.

8. The apparatus as claimed in claim 7, wherein the carrying element comprises a wheel-like structure and a plurality of arms mounted on the wheel-like structure, one behind the other in the circumferential direction, the arms carrying on their free end region an opening element and, in dependence on the rotational position of the carrying element the arms being swivelled from a rest position, with the longitudinal extent running approximately in the radial direction, into a working position, with the longitudinal extent running approximately parallel to the axis of rotation.

9. The apparatus as claimed in claim 8, wherein the axis of rotation is above the conveying plane and the arms extend in the rest position outward from the swivel pins in a radial direction.

10. The apparatus as claimed in claim 8, wherein the axis of rotation is above the conveying plane and the arms extend in the rest position inward from the swivel spindles in a radial direction.

11. The apparatus as claimed in claim 2, wherein the supporting element comprising supporting bands which are driven to circulate at a greater speed ($v_s$) than a conveying speed ($v_f$) of the conveying device and on which the printed products rest with their forward-bent end region.

12. The apparatus as claimed in claim 11, comprising a cam belt which is driven to circulate cyclically and straightening cams, the straightening cams protruding from the cam belt and in the region of the upper strand of cam belt projecting beyond the supporting bands the straightening cams in this region moving at a speed ($v_n$) which is no greater than the conveying speed ($v_f$), and the printed products being urged into bearing contact against the straightening cams with their edge opposite the fold for aligning.

13. The apparatus as claimed in claim 12, wherein the holding elements circulate at a speed ($v_u$) which is no greater than a speed ($v_n$) of the straightening cams, and, in the opening section the speed of the opening elements is greater than the speed ($v_u$) of the holding elements and less than the conveying speed ($v_f$).

14. The apparatus as claimed in claim 2, comprising a processing device disposed downstream of the opening unit, the processing device including circulating saddlelike rests, which in each case enter between the product parts of the opened and held-open printed products and the printed products into bearing contact astride the saddlelike rest after the opening of the transporting clips.

* * * * *